US006763882B2

(12) United States Patent
Demny et al.

(10) Patent No.: US 6,763,882 B2
(45) Date of Patent: Jul. 20, 2004

(54) INSULATED CASING AND TUBING HANGERS

(75) Inventors: Albert Demny, Houston, TX (US); Paul Horton, Jr., Lafayette, LA (US)

(73) Assignee: Seaboard International, Inc., Houston, TX (US)

( * ) Notice: Subject to any disclaimer, the term of this patent is extended or adjusted under 35 U.S.C. 154(b) by 0 days.

(21) Appl. No.: 10/290,141

(22) Filed: Nov. 7, 2002

(65) Prior Publication Data

US 2004/0089444 A1 May 13, 2004

(51) Int. Cl.[7] ..... E21B 43/10
(52) U.S. Cl. ..... 166/208; 166/57; 166/89.3
(58) Field of Search ..... 166/57, 65.1, 77.53, 166/88.2, 88.3, 88.4, 89.3, 208

(56) References Cited

U.S. PATENT DOCUMENTS 4,491,176 A 1/1985 Reed
4,494,778 A 1/1985 Johnson
4,678,209 A 7/1987 Guice
4,852,648 A 8/1989 Akkerman et al.
4,923,006 A * 5/1990 Hartmann et al. ..... 166/65.1
5,052,941 A 10/1991 Hernandez-Marti et al.
5,176,218 A 1/1993 Singer et al.
5,280,766 A 1/1994 Mohn
5,377,747 A * 1/1995 Didier ..... 166/65.1
5,794,693 A 8/1998 Wright et al.
6,015,009 A 1/2000 Allen
6,095,242 A 8/2000 Lequang et al.
6,220,363 B1 4/2001 Dallas
6,530,433 B2 * 3/2003 Smith et al. ..... 166/387

* cited by examiner

*Primary Examiner*—Zakiya Walker
(74) *Attorney, Agent, or Firm*—Adams and Reese LLP

(57) ABSTRACT

In order to prevent potential electrical hazards associated with supplying power downhole, a hanger is provided for either casing or tubing strings, or a plurality of casing or tubing strings, that electrically insulates the internal suspension mechanism of the hanger from the hanger's external seal. Electrical power is typically transferred through a hanger by way of the internal suspension mechanism. If electrical umbilicals are used, connecting devices may be located within the internal suspension mechanism for connecting an upper and lower umbilical and transferring power trough the hanger. If a rigid tubular conductor is used, the suspension mechanism may be ported to allow the passage of electrical feedthroughs or, in the case of tubing hangers, the tubing itself may be charged with electrical power. By insulating the suspension mechanism from the external seal potential electrical hazards are eliminated.

31 Claims, 5 Drawing Sheets

INSULATED CASING AND TUBING HANGERS

STATEMENT REGARDING FEDERALLY SPONSORED RESEARCH OR DEVELOPMENT

Not Applicable

FIELD OF THE INVENTION

The present invention relates generally to the suspension of conduits, and more particularly to the hanging of production and casing strings of piping used for the production of hydrocarbons. More specifically, the present invention relates to hangers employed for suspending wellhead casings and production tubing when electrical power is supplied through the wellhead to downhole equipment.

BACKGROUND OF THE INVENTION

After a well has been drilled, the well must be completed before hydrocarbon production can begin. The first step in completing a well is the installation of casing pipe in the well. Wells usually require two or more concentric strings of casing pipe. A casing string is a long section of connected pipe that is lowered into the wellbore and cemented. Hydrocarbon wells typically require four concentric casing strings: conductor casing, surface casing, intermediate casing, and production casing. The various casings extend into the wellbore to different depths to protect aquifers, to provide pressure integrity and to ensure isolation of production formations. After cementing the production casing, a final string of tubing is typically run down the well bore.

All of the surface equipment that supports the various pipe strings, seals off the well, and controls the paths and flow rates of reservoir fluids is referred to as the wellhead. All wellheads have at least one casing head and casing hanger. If multiple casings are installed, the wellhead will have a casing head and casing hanger associated with each concentric string of casing. If a tubing string is employed, the wellhead will also have a tubing head and tubing hanger. Each string of casing and the tubing string hang from its respective head. The heads are usually stacked upon one another with the tubing head stacked above the uppermost casing head. Hangers are used within the various heads to ensure that its respective string is correctly located. With some applications, a single hanger may be used to hang a plurality of pipe strings from a single head. For example, U.S. Pat. No. 5,794,693 discloses a dual tubing string hanger, which is herein incorporated by reference. Typically, hangers also incorporate sealing devices or systems to isolate the casing annulus from the upper wellhead components.

Many hydrocarbon wells are fitted with permanent sensors, such as pressure and temperature sensors, which require electrical power to transmit signals from the sensors to a remote point at the surface. Hydrocarbon wells may also employ subsurface equipment, such as pumps or heaters, which may also require electrical power. In order to supply power to these subsurface pieces of equipment, electric current from a source outside of the wellhead must be transferred through the wellhead to the electrically responsive device. Electrical power can be supplied downhole by several methods, including electrical umbilical cords, rigid tubular conductors, or more recently via coiled tubing. No matter which method of power supply is employed, in order to transfer the power through the wellhead, the power supply must be transferred through either the tubing hanger or the casing hanger.

The extreme environmental conditions inside the wellhead coupled with the rough nature of completion operations often cause damage to devices used to supply electrical power. Damaged equipment can potentially lead to electrical short-circuits that can present a hazard to persons working around the wellhead. Since the majority of the wellhead equipment is constructed of conductive materials, an electrical short inside of the wellhead can charge the outer surface of the wellhead. Unprotected persons may be exposed to electrical shock if contact is made with the wellhead's outer surface.

SUMMARY OF THE INVENTION

The present invention addresses the potential electrical hazards associated with supplying power downhole. Generally, a hanger is provided for either casing or tubing strings, or a plurality of casing or tubing strings, that electrically insulates the internal suspension means of the hanger from the external sealing means of the hanger. Electrical power is typically transferred through a hanger by way of the internal suspension means. If electrical umbilicals are used, connecting devices may be located within the internal suspension means for connecting an upper and lower umbilical and transferring power through the hanger. If a rigid tubular conductor is used, the suspension means may be ported to allow the passage of electrical feedthroughs or, in the case of tubing hangers, the tubing itself may be charged with electrical power. By insulating the suspension means from the sealing means, which is in communication with the external surface of the wellhead, any potential electrical hazard is eliminated.

PREFERRED EMBODIMENTS OF THE INVENTION

In the following detailed description of the preferred embodiments, reference is made to the accompanying drawings, which form a part hereof, and in which are shown by way of illustration specific embodiments in which the invention may be practiced. It is to be understood that other embodiments may be utilized and structural changes may be made without departing from the scope of the present invention.

Figure 1:
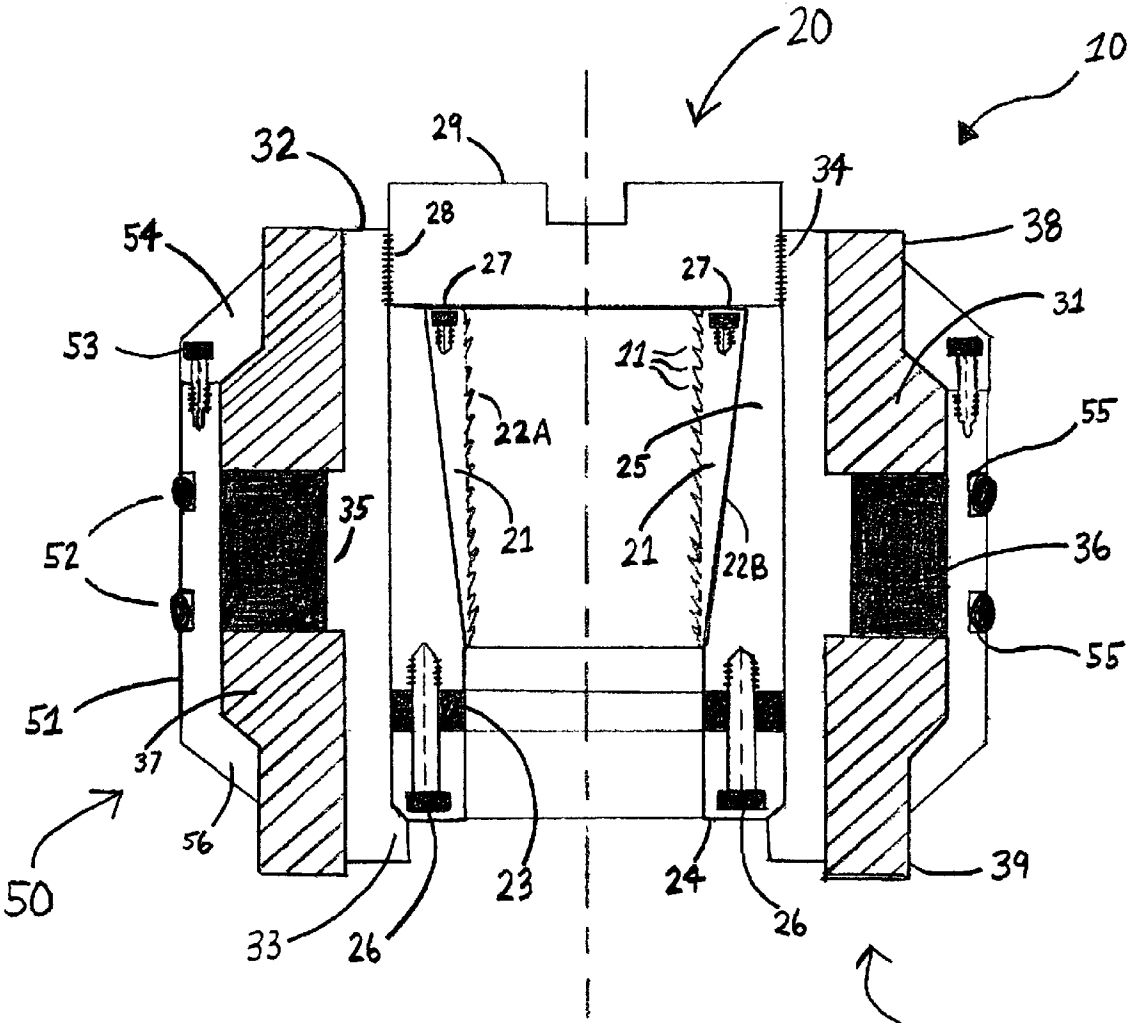
FIG. 1 is a side cross-sectional view of one preferred embodiment of an insulated hanger, featuring a slip-type suspension means centrally located within an inner reducer bowl and insulated from the outer reducer bowl by annular insulating members.

FIG. 1 shows an insulated slip-type hanger to in accordance with the present invention. Hanger 10 may be used to suspend casings or production tubing. Hanger 10 is generally configured to fit inside a casing or tubing head where the hanger 10 centrally locates the appropriate conduit. The external configuration of the hanger 10 may vary with the arrangement of various standard casing and tubing heads. Also, while the described preferred embodiments of the insulated hanger are directed toward hangers that suspend a single pipe string, the internal suspension means can be easily modified to suspend a plurality of pipe strings from a single insulated.

Hanger 10 generally comprises three sections, namely the internal suspension means section 20, the annular insulating member section 30, and the external sealing means section 50. The internal suspension means section 20 of the preferred embodiment of the hanger 10 depicted in FIG. 1 has a slip-type configuration. A plurality of segmental slip members 21 is received within a cylindrical upper body 25. The segmental slip members 21 are generally wedge shaped having a smooth outer surface on its exterior inclined face 22B and a vertical series of parallel teeth 11 along its interior face 22A. Once installed, the series of teeth 11 of the segmental slip members 21 have an arcuate profile for engaging the outer surface of the casing string or tubing string to be hung.

The upper body 25 has an interior surface that slopes downwardly and inwardly to accommodate the smooth exterior inclined face 22B of the segmental slip members 21. A sealing ring 23 is attached to the bottom of the upper body 25 to seal the annular region of the casing or tubing string from the portion of the wellhead above the hanger 10. The sealing ring 23 is preferably an elastomer, but may be manufactured of any sealing material compatible with the environment within the wellhead. The screws 26 on the bottom packing plate 24 holds the seal in place.

The upper body 25 is centrally located within a cylindrical inner body, referred to as the inner reducer bowl 32. The bottom edge of the inner reducer bowl 32 has an inwardly facing lip 33 that engages with the bottom packing plate 24 and prevents the upper body 25 from sliding downward through the inner reducer bowl 32. The top edge of the inner reducer bowl 32 has female threads 34 along its inside surface. A gland 29, having male threads 28, is screwed into the top of the inner reducer bowl 32 and secures the upper body 25 and the segmental slip members 21 within the inner reducer bowl 32. The outer surface of the inner reducer bowl 32 has a sealing projection 35 that engages the sealing packoff 36. Sealing packoff 36, similar to sealing ring 23, prevents fluid migration from the annular region of the casing or tubing string into the portion of the wellhead above the hanger 10. Like sealing ring 23, the sealing packoff 36 is preferably an elastomer, but may be manufactured of any sealing material compatible with the environment within the wellhead.

The annular insulating member section 30 of hanger 10 comprises an upper cylindrical insulating member 38 and a lower cylindrical insulating member 39 separated by the sealing packoff 36. The upper cylindrical insulating member 38 engages the exterior surface of the inner reducer bowl 32 above the sealing projection 35. The lower cylindrical insulating member 39 engages the exterior surface of the inner reducer bowl 32 below the sealing projection 35. The upper annular insulating member 38 has an outwardly facing lip 31 on its bottom edge. The lower annular insulating member 39 has an outwardly facing lip 37 on its top edge.

The annular insulating members 38, 39 comprise an appropriate insulating material suitable for the environmental conditions inside the wellhead. Simple plastics and composite materials, generally consisting of a thermoset resin impregnated substrate, have suitable mechanical and insulating properties and are also economically attractive materials of construction. Machinable ceramics have good mechanical and insulating properties, but the use of ceramics is presently limited by cost. Suitable insulating materials should have a dielectric strength of at least about 250 volts/mil.

Simple plastics suitable for manufacturing annular insulating members 38, 39 include chlorinated polyvinyl chloride, polyoxymethylene, polyamide, polybenzimidazole, polyethylene terephthalate polyester, polyphenylene oxide-styrene alloy, polyetherethylketone, polycarbonate, polyetherimide, polyimide, polypropylene, polysulfone, polyphenylene sulfide, polytetrafluoroethylene, and polyamide-imide. The most preferred simple plastic is polyetherethylketone.

Composite materials, also known as industrial laminates, may be formed from several different substrates including paper, cotton, fiberglass or other synthetic fibers. The resins used to impregnate the layers of the substrate greatly affect the dielectric strength of the composite. Resins that impart good electrical resistance to the composite material include phenolic and epoxy resins. The following composites are suitable for manufacturing insulating members 38, 39: fiberglass reinforced epoxy resin, paper reinforced phenolic resin, cotton canvas reinforced phenolic resin and cotton linen reinforced phenolic resin. The most preferred composite materials are fiberglass reinforced epoxy resins having NEMA grades G10/FR4 or G11/FR5.

The upper and lower annular insulating members 38, 39 may be formed entirely a suitable insulating material or the annular insulating members maybe coated articles having a sufficient layer of insulating material to inhibit the conduction of electricity.

After slidingly engaging the upper annular insulating member 38 and the lower annular insulating member 39 onto the inner reducer bowl 32 and slidingly engaging the sealing packoff 36 onto the sealing projection 35 of the inner reducer bowl 32, the entire assembly is centrally located within the cylindrical outer body, referred to as the outer reducer bowl 51. The bottom edge of the outer reducer bowl 51 has an inwardly facing lip 56 that engages with the outwardly facing lip 37 of the lower annular insulating member 39. The exterior surface of the outer reducer bowl 51 includes at least one sealing groove 55 wherein a sealing ring 52 is positioned to form a seal with the inner surface of the casing or tubing head. The sealing ring 52 is preferably an elastomer, but may be manufactured of any sealing material compatible with the environment within the wellhead. Preferably, the outer reducer bowl 51 includes two sealing grooves 55 and two sealing rings 52. Top plate 54 engages with the outwardly facing lip 31 of the upper annular insulating member 38, as well as the top edge of the outer reducer bowl 51 and is held in place by screws 53, thus completing the hanger assembly 10.

Figure 2:
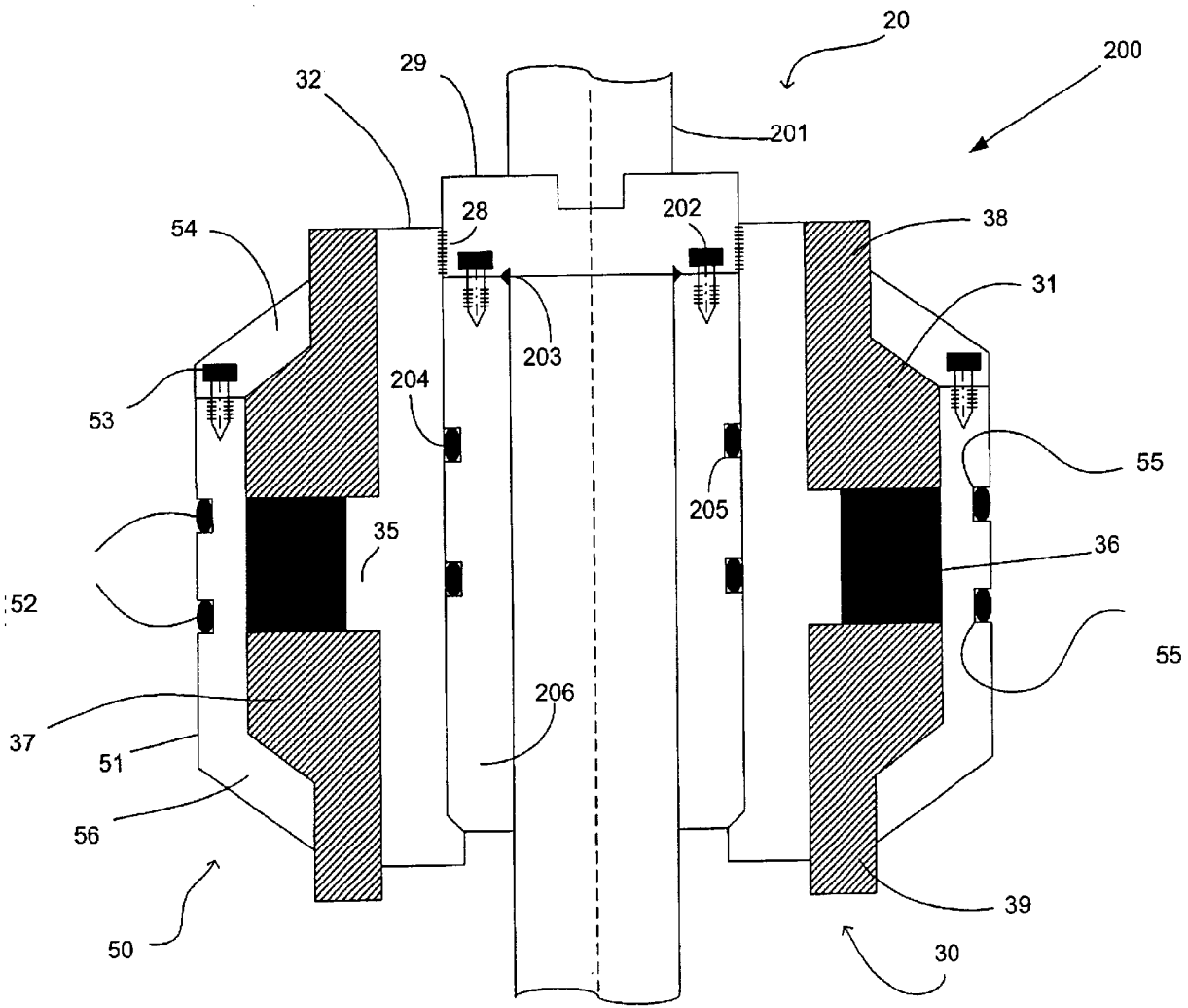
FIG. 2 is a side cross-sectional view of one preferred embodiment of an insulated hanger, featuring a welded mandrel-type suspension means centrally located within an inner reducer bowl and insulated from the outer reducer bowl by annular insulating members.

FIG. 2 shows another preferred embodiment of the present invention. The hanger 200 generally comprises the same three sections as the embodiment depicted in FIG. 1, namely an internal suspension means section 20, the annular insulating member section 30, and the external sealing means section 50. The primary difference being the internal suspension means 20 has a welded mandrel-type configuration rather than a slip-type configuration.

As shown in FIG. 2, the mandrel 206 is centrally located within the inner reducer bowl 32. The outer surface of the mandrel 206 includes at least one sealing groove 205, similar to those found on the outer surface of the outer reducer bowl 51, wherein a sealing ring 204 is positioned to form a seal between the inner reducer bowl 32 and the mandrel 206. Preferably, the mandrel 206 includes two sealing grooves 205 and two sealing rings 204. Similar to all the sealing components of the present invention, sealing ring 204 is preferably an elastomer, but may be manufactured of any sealing material compatible with the environment within the wellhead.

The mandrel 206 is fastened to the tubing or casing being hung via welded connection 203. Gland 29, having male threads 28, is screwed into the top of the inner reducer bowl 32 and secures the mandrel 206 within the inner reducer bowl 32. Screws 202 further secure gland 29.

Figure 3:
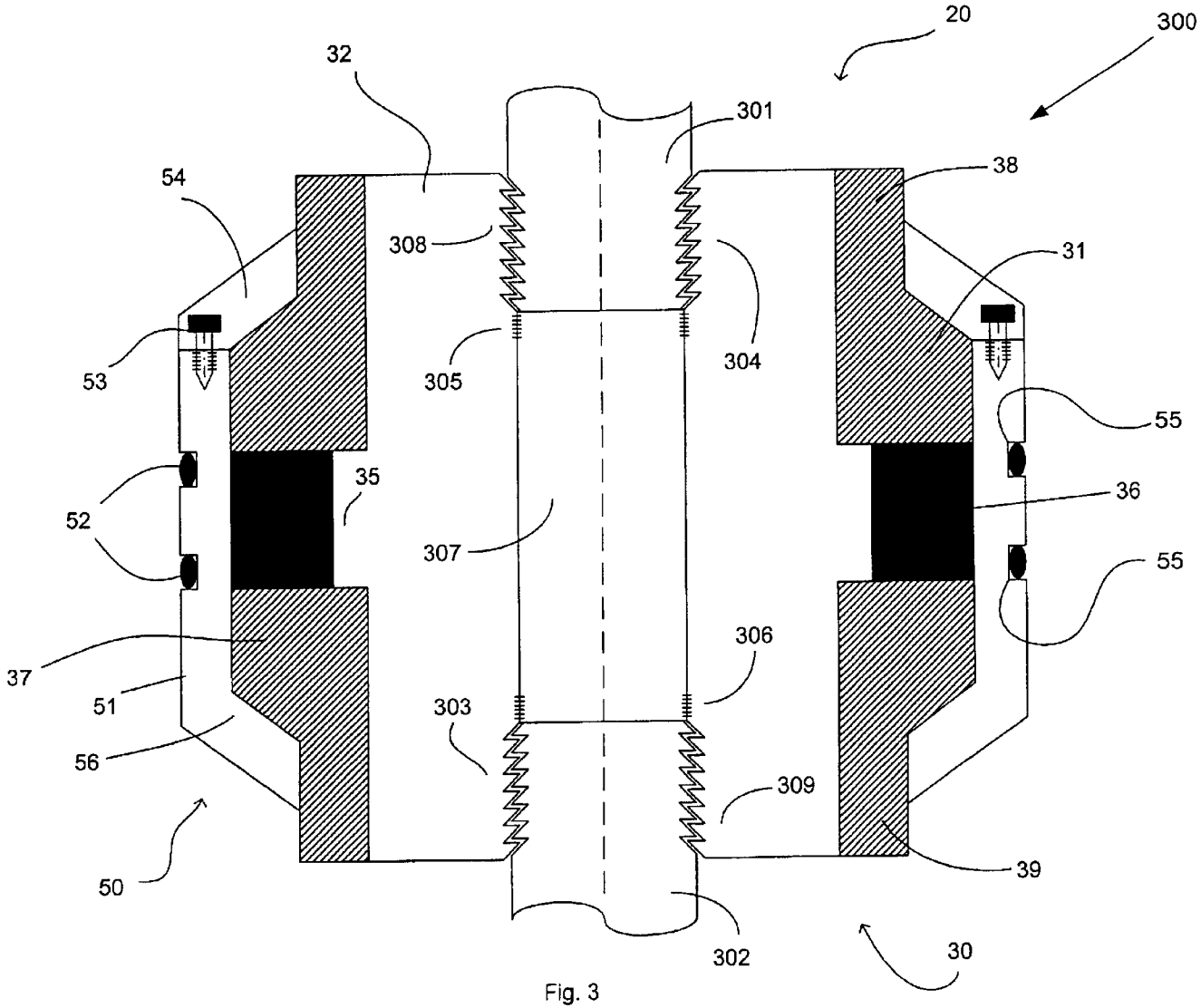
FIG. 3 is a side cross-sectional view of one preferred embodiment of an insulated hanger, featuring a threaded mandrel-type suspension means centrally located within an inner reducer bowl and insulated from the outer reducer bowl by annular insulating members.

FIG. 3 shows yet another preferred embodiment of the present invention. Again, hanger 300 generally comprises the same three sections as the embodiments depicted in FIGS. 1 and 2, namely an internal suspension means section 20, the annular insulating member section 30, and the external sealing means section 50. The internal suspension means 20 of hanger 300 comprises a threaded mandrel-type configuration.

As shown in FIG. 3, a threaded section of tubing 307 is centrally located within inner reducer bowl 32. The inside upper surface 304 of the inner reducer bowl 32 includes female threads 308. The inside lower surface 303 of inner reducer bowl 32 includes female threads 309. Female threads 308 mate the hanger 300 to a mandrel head (not shown). Female threads 309 mate the hanger 300 to the tubing or casing being hung.

Figure 4:
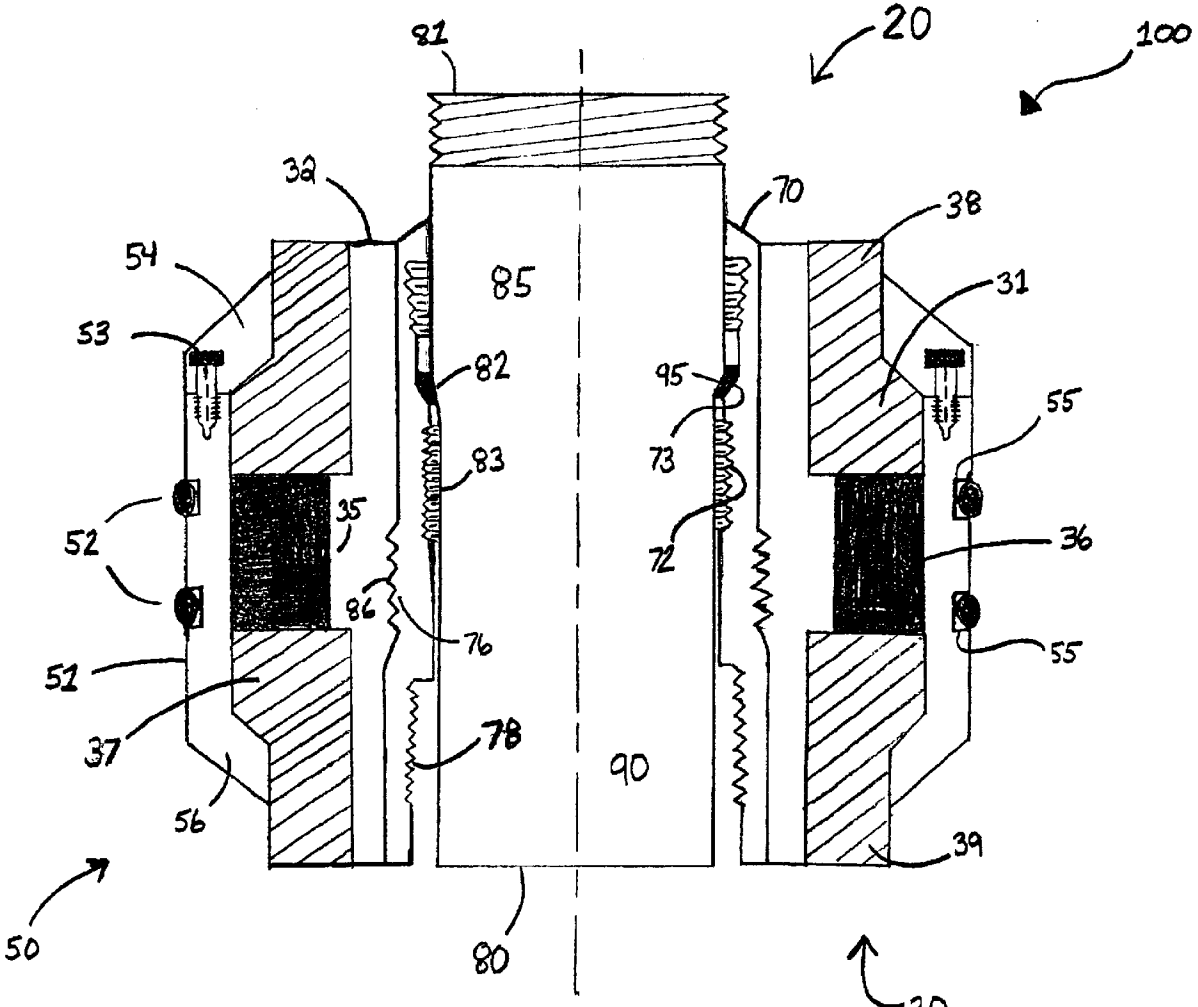
FIG. 4 is a side cross-sectional view of another preferred embodiment of an insulated hanger, featuring a threaded mandrel-type suspension means centrally located within an inner reducer bowl and insulated from the outer reducer bowl by annular insulating members

FIG. 4 shows another preferred embodiment of the present invention. Once more, the hanger 100 generally comprises the same three sections as the embodiment depicted in FIG. 1, namely an internal suspension means section 20, the annular insulating member section 30, and the external sealing means section 50. The internal suspension means 20 of the hanger depicted in FIG. 4 includes a different embodiment of a threaded mandrel-type configuration.

As shown in FIG. 4, the mandrel 80 is a length of high pressure tubing. The top end of the mandrel 80 includes a threaded connection 81 for mating to a mandrel head (not shown). The outer surface of the mandrel 80 includes an upper section 85 and having a first diameter and a lower section 90 having a second diameter smaller than the first diameter. The transition from the first diameter to the second diameter forms a scaling edge 82. The lower section 90 of the mandrel 80 includes a threaded section 83 on its outer surface.

The mandrel 80 is centrally located within a cylindrical mandrel housing 70. The mandrel housing 70 also includes a threaded section 72 that engages with the threaded section 83 of the mandrel 80, thus securing the mandrel 80 within the mandrel housing 70. Like the mandrel 80, the mandrel housing includes a sealing edge 73 that mates with the scaling edge 82 of the mandrel 80. A sealing ring 95 is located between the sealing edges 73, 82 to prevent fluid migration from the annular region of the casing or tubing string into the portion of the wellhead above the hanger 100. Mandrel housing 70 also includes a threaded section 78 on its bottom edge for connecting the top portion of the casing or tubing being hung.

The mandrel housing 70 is centrally located within the inner reducer bowl 32 of the hanger 100. The inner reducer bowl 32 has a threaded section 86 on its interior surface that engages with a threaded section 76 on the exterior surface of the mandrel housing 70, thus securing the mandrel housing 70 to the inner reducer bowl 32. The remainder of the hanger assembly 100, which includes the upper annular insulating member 38, the lower annular insulating member 39, the sealing packoff 36, the outer reducer bowl 51 and the top plate 54, is identical to the hanger assemblies shown in the previous figures.

Figure 5:
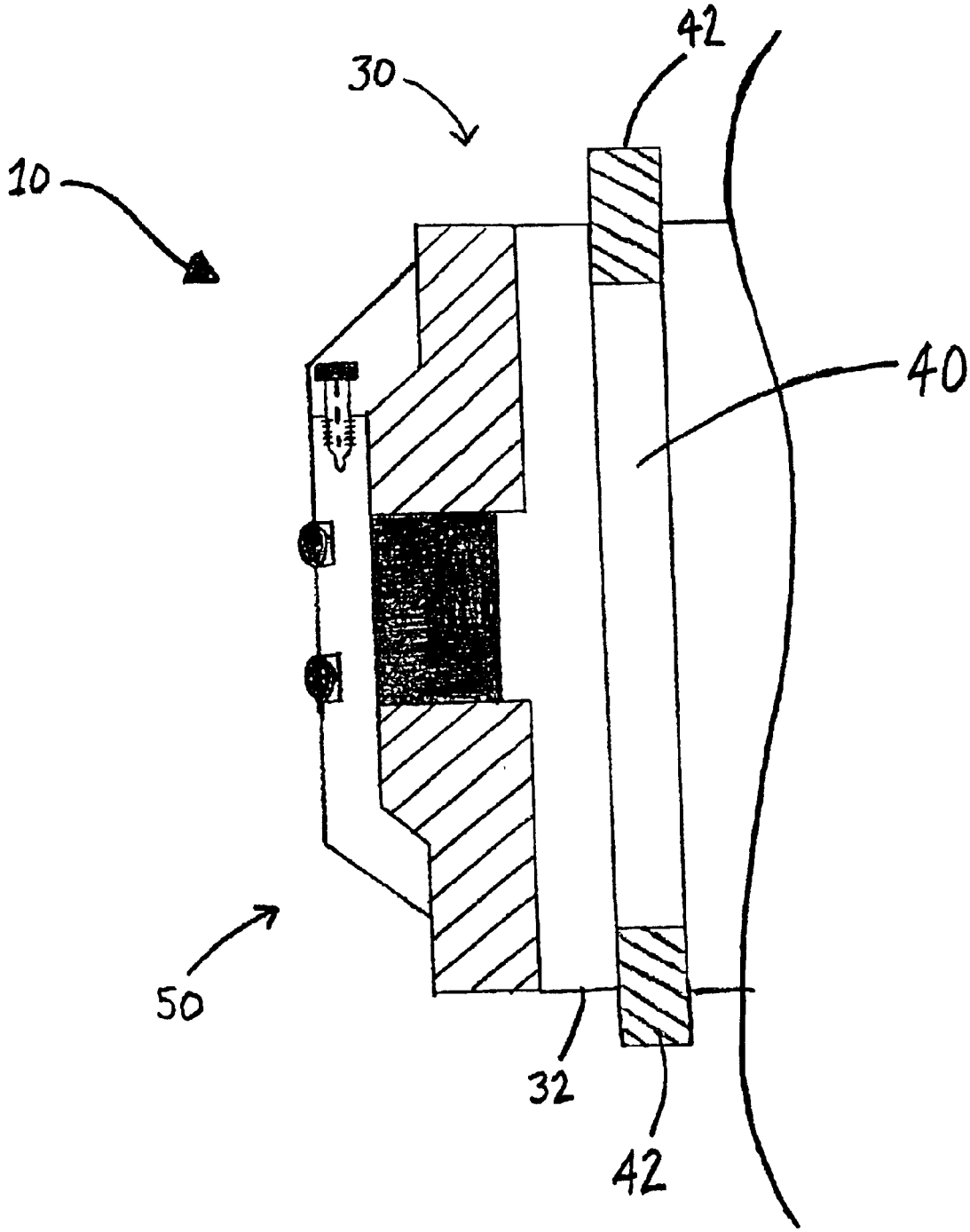
FIG. 5 is a partial side cross-sectional of an insulated hanger according to the present invention, featuring an inner reducer bowl fitted with an electrical feedthrough and its associated electrical connectors. The internal suspension means is not shown.

FIG. 5 depicts a partial cross-sectional view of an insulated hanger according to the present invention. Only the external sealing section 50, the annular insulating member section 30 and the inner reducer bowl 32 are shown in the figure. The inner reducer bowl 32 includes a port 40 for the feedthrough of electrical power through the hanger 10. Electrical connections 42 are provided on the top and bottom faces of the inner reducer bowl 32 for connecting electrical umbilicals. The means of providing electrical feedthroughs through casing and tubing hangers is well known in the art. For example, U.S. Pat. Nos. 4,852,648, 4,491,176 and 5,052,941 describe various means of supplying power downhole through the wellhead equipment. The present invention may be used with any of these systems to protect against potential electrical shock hazards associated with damaged electrical equipment.

Although the present invention has been described in terms of specific embodiments, it is anticipated that alterations and modifications thereof will no doubt become apparent to those skilled in the art. It is therefore intended that the following claims be interpreted as covering all alterations and-modifications that fall within the true spirit and scope of the invention.

What is claimed is:

1. An insulated hanger for suspending at least one inner pipe string within a wellhead comprising:

an internal suspension means for suspending said at least one inner pipe string;

an inner body fixedly secured around said internal suspension means, said inner body comprising an upper cylindrical section, a lower cylindrical section, and a middle cylindrical section;

an upper annular insulating member slidingly engaged around said upper cylindrical section of said inner body, said upper annular insulating member having a top end and a bottom end, said top end having a first diameter and said bottom end having a second diameter greater than said first diameter;

a lower annular insulating member slidingly engaged around said lower cylindrical section of said inner body, said lower annular insulating member having a top end and a bottom end, said bottom end having a first diameter and said top end having a second diameter greater than said first diameter;

a sealing ring slidingly engaged around said middle cylindrical section of said inner body, said sealing ring having a top face engaged with said bottom end of said upper annular insulating member and a bottom face engaged with said top end of said lower annular insulating member; and an outer body fixedly secured around said top end of said lower annular insulating member, said sealing ring and said bottom end of said upper annular insulating member, said outer body having an exterior face and said exterior face of said outer body comprising a means for sealing said exterior face within said wellhead.

2. The insulated hanger of claim 1, wherein said upper cylindrical section and said lower cylindrical section of said inner body have substantially equivalent diameters and said middle cylindrical section of said inner body has a diameter greater than said upper and said lower cylindrical sections.

3. The insulated hanger of claim 1, wherein said internal suspension means is a slip-type suspension means.

4. The insulated hanger of claim 1, wherein said internal suspension means is a welded mandrel-type suspension means.

5. The insulated hanger of claim 1, wherein said internal suspension means is a threaded mandrel-type suspension means.

6. The insulated hanger of claim 1, wherein said upper annular insulating member and said lower annular insulating member comprise an insulating material selected from the group consisting of chlorinated polyvinyl chloride, polyoxymethylene, polyamide, polybenzimidazole, polyethylene terephthalate polyester, polyphenylene oxide-styrene alloy, polyetherethylketone, polycarbonate, polyetherimide, polyimide, polypropylene, polysulfone, polyphenylene sulfide, polytetrafluoroethylene, and polyamide-imide.

7. The insulated hanger of claim 1, wherein said upper annular insulating member and said lower annular insulating member comprise polyetherethylketone.

8. The insulated hanger of claim 1, wherein said upper annular insulating member and said lower annular insulating member comprise an insulating composite material selected from the group consisting of fiberglass reinforced epoxy resin, paper reinforced phenolic resin, cotton canvas reinforced phenolic resin and cotton linen reinforced phenolic resin.

9. The insulated hanger of claim 1, wherein said upper annular insulating member and said lower annular insulating member comprise fiberglass reinforced epoxy resin.

10. The insulated hanger of claim 1, wherein said upper annular insulating member and said lower annular insulating member comprise a material having a dielectric strength of at least about 250 volts per mil.

11. The insulated hanger of claim 1, wherein said means for sealing said exterior face of said outer body comprises a plurality of sealing grooves disposed around said exterior face of said outer body and a plurality of sealing rings disposed within said sealing grooves.

12. The insulated hanger of claim 1, wherein said inner body further comprises a means for transferring electrical power from a source above said insulated hanger to a electrically responsive device below said insulated hanger.

13. An insulated hanger for suspending an inner pipe string within a wellhead comprising:

an internal slip means for suspending said inner pipe string, said internal slip means comprising a cylindrical slip body having a top edge, a bottom edge, a substantially smooth external surface and an inclined internal surface, said inclined internal surface beginning at said top edge of said cylindrical slip body and progressing downwardly and inwardly towards said bottom edge of said cylindrical slip body, a plurality of slip members disposed circumferentially about said inclined internal surface of said cylindrical slip body and forming a central bore, said slip members having an inner surface with a series of teeth engageable into said inner pipe string disposed in said central bore, a sealing ring in communication with said bottom edge of said cylindrical slip body, a bottom packing plate, said bottom packing plate having means for securing said sealing ring substantially between said cylindrical slip body and said bottom packing plate, and a gland in communication with said top edge of said cylindrical slip body, said gland securing said slip members within said cylindrical slip body;

an inner body disposed around said internal slip means, said inner body comprising an upper cylindrical section, a lower cylindrical section, and a middle cylindrical section; an upper annular insulating member slidingly engaged around said upper cylindrical section of said inner body, said upper annular insulating member having a top end and a bottom end; a lower annular insulating member slidingly engaged around said lower cylindrical section of said inner body, said lower annular insulating member having a top end and a bottom end; a sealing ring slidingly engaged around said middle cylindrical section of said inner body, said sealing ring having a top face engaged with said bottom end of said upper annular insulating member and a bottom face engaged with said top end of said lower annular insulating member; and an outer body fixedly secured around said lower annular insulating member, said sealing ring and said upper annular insulating member, said outer body having an exterior face and said exterior face of said outer body comprising a means for sealing said exterior face within said wellhead.

14. The insulated hanger of claim 13, wherein said upper cylindrical section and said lower cylindrical section of said inner body have substantially equivalent diameters and said middle cylindrical section of said inner body has a diameter greater than said upper and said lower cylindrical sections.

15. The insulated hanger of claim 13, wherein said upper annular insulating member comprises a top end having a first diameter and a bottom end having a second diameter greater than said first diameter of said top end of said upper annular insulating member, said lower annular insulating member comprises a bottom end having a first diameter and a top end having a second diameter greater than said first diameter of said bottom end of said lower annular insulating member, and said outer body is fixedly secured around said top end of said lower annular insulating member, said sealing ring and said bottom end of said upper annular insulating member.

16. The insulated hanger of claim 13, wherein said upper annular insulating member and said lower annular insulating member comprise an insulating material selected from the group consisting of chlorinated polyvinyl chloride, polyoxymethylene, polyamide, polybenzimidazole, polyethylene terephthalate polyester, polyphenylene oxide-styrene alloy, polyetherethylketone, polycarbonate, polyetherimide, polyimide, polypropylene, polysulfone, polyphenylene sulfide, polytetrafluoroethylene, and polyamide-imide.

17. The insulated hanger of claim 13, wherein said upper annular insulating member and said lower annular insulating member comprise polyetherethylketone.

18. The insulated hanger of claim 13, wherein said upper annular insulating member and said lower annular insulating member comprise an insulating composite material selected from the group consisting of fiberglass reinforced epoxy resin, paper reinforced phenolic resin, cotton canvas reinforced phenolic resin and cotton linen reinforced phenolic resin.

19. The insulated hanger of claim 13, wherein said upper annular insulating member and said lower annular insulating member comprise fiberglass reinforced epoxy resin.

20. The insulated hanger of claim 13, wherein said upper annular insulating member and said lower annular insulating member comprise a material having a dielectric strength of at least about 250 volts per mil.

21. The insulated hanger of claim 13, wherein said means for sealing said exterior face of said outer body comprises a plurality of sealing grooves disposed around said exterior face of said outer body and a plurality of sealing rings disposed within said sealing grooves.

22. The insulated hanger of claim 13, wherein said inner body further comprises a means for transferring electrical power from a source above said insulated hanger to a electrically responsive device below said insulated hanger.

23. An insulated hanger for suspending an inner pipe string within a wellhead comprising:

an internal threaded mandrel-type suspension means for suspending said inner pipe string, said internal mandrel-type suspension means comprising an tubular mandrel comprising an upper end and a lower end and at least one set of threads disposed along the exterior surface of said mandrel;

an inner body disposed around said internal mandrel-type suspension means, said inner body comprising an upper cylindrical section having threads on the inside surface of said upper cylindrical section, a lower cylindrical section having threads on the inside surface of said lower cylindrical section, and a middle cylindrical section;

an upper annular insulating member slidingly engaged around said upper cylindrical section of said inner body, said upper annular insulating member having a top end and a bottom end, said top end having a first diameter and said bottom end having a second diameter greater than said first diameter;

a lower annular insulating member slidingly engaged around said lower cylindrical section of said inner body, said lower annular insulating member having a top end and a bottom end, said bottom end having a first diameter and said top end having a second diameter greater than said first diameter;

a sealing ring slidingly engaged around said middle cylindrical section of said inner body, said sealing ring having a top face engaged with said bottom end of said upper annular insulating member and a bottom face engaged with said top end of said lower annular insulating member; and an outer body fixedly secured around said top end of said lower annular insulating member, said sealing ring and said bottom end of said upper annular insulating member, said outer body having an exterior face and said exterior face of said outer body comprising a means for sealing said exterior face within said wellhead.

24. The insulated hanger of claim 23, wherein said upper cylindrical section and said lower cylindrical section of said inner body have substantially equivalent diameters and said middle cylindrical section of said inner body has a diameter greater than said upper and said lower cylindrical sections.

25. The insulated hanger of claim 23, wherein said upper annular insulating member and said lower annular insulating member comprise an insulating material selected from the group consisting of chlorinated polyvinyl chloride, polyoxymethylene, polyamide, polybenzimidazole, polyethylene terephthalate polyester, polyphenylene oxide-styrene alloy, polyetherethylketone, polycarbonate, polyetherimide, polyimide, polypropylene, polysulfone, polyphenylene sulfide, polytetrafluoroethylene, and polyamide-imide.

26. The insulated hanger of claim 23, wherein said upper annular insulating member and said lower annular insulating member comprise polyetherethylketone.

27. The insulated hanger of claim 23, wherein said upper annular insulating member and said lower annular insulating member comprise an insulating composite material selected from the group consisting of fiberglass reinforced epoxy resin, paper reinforced phenolic resin, cotton canvas reinforced phenolic resin and cotton linen reinforced phenolic resin.

28. The insulated hanger of claim 23, wherein said upper annular insulating member and said lower annular insulating member comprise fiberglass reinforced epoxy resin.

29. The insulated hanger of claim 23, wherein said upper annular insulating member and said lower annular insulating member comprise a material having a dielectric of at least about 250 volts per mil.

30. The insulated hanger of claim 23, wherein said means for sealing said exterior face of said outer body comprises a plurality of sealing grooves disposed around said exterior face of said outer body and a plurality of sealing rings disposed within said sealing grooves.

31. The insulated hanger of claim 23, wherein said inner body further comprises a means for transferring electrical power from a source above said insulated hanger to a electrically responsive device below said insulated hanger.

* * * * *